US009940863B2

(12) United States Patent
An

(10) Patent No.: US 9,940,863 B2
(45) Date of Patent: Apr. 10, 2018

(54) DISPLAY DEVICE AND METHOD FOR DRIVING THE SAME

(71) Applicant: SAMSUNG DISPLAY CO., LTD., Yongin-si, Gyeonggi-do (KR)

(72) Inventor: Bo-Young An, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 112 days.

(21) Appl. No.: 14/855,112

(22) Filed: Sep. 15, 2015

(65) Prior Publication Data

US 2016/0329019 A1 Nov. 10, 2016

(30) Foreign Application Priority Data

May 8, 2015 (KR) ..... 10-2015-0064351

(51) Int. Cl.
*G09G 3/34* (2006.01)
*G09G 3/20* (2006.01)

(52) U.S. Cl.
CPC ..... *G09G 3/20* (2013.01); *G09G 2320/0271* (2013.01); *G09G 2320/0626* (2013.01); *G09G 2320/0673* (2013.01); *G09G 2330/028* (2013.01)

(58) Field of Classification Search
CPC combination set(s) only.
See application file for complete search history.

(56) References Cited

U.S. PATENT DOCUMENTS

2013/0321485 A1* 12/2013 Eom ..... G09G 3/3208 345/690
2014/0118228 A1* 5/2014 Kang ..... G09G 3/3233 345/77
2014/0267359 A1* 9/2014 Chae ..... G06T 7/00 345/589
2014/0292838 A1* 10/2014 Won ..... G09G 3/3225 345/691
2015/0154903 A1* 6/2015 Miura ..... G09G 3/2003 345/690

FOREIGN PATENT DOCUMENTS

KR 10-2013-0136338 A 12/2013
KR 10-2014-0055314 A 5/2014
KR 10-2014-0114098 A 9/2014
KR 10-2014-0119511 A 10/2014
KR 10-2014-0127569 A 11/2014

* cited by examiner

*Primary Examiner* — Van Chow
(74) *Attorney, Agent, or Firm* — Lewis Roca Rothgerber Christie LLP

(57) ABSTRACT

A display device according to example embodiments includes: a display panel including a plurality of pixels configured to display an image; a gamma voltage generator configured to generate a plurality of gamma sets respectively corresponding to a plurality of luminance ranges, and configured to compare a target luminance level with the luminance ranges to select a target gamma set among the gamma sets, and to generate a plurality of gamma voltages using the target gamma set, the target luminance level being a luminance level of the image; a first dimming controller configured to scale input image data based on the target luminance level; a second dimming controller configured to determine an off duty ratio of an emission signal based on the target luminance level; and a display panel driver configured to drive the display panel based on the input image data and the gamma voltages.

20 Claims, 12 Drawing Sheets

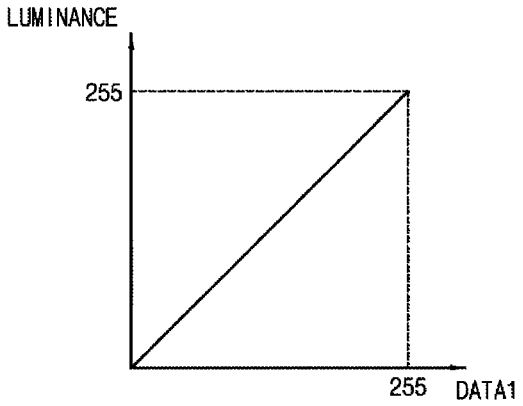
FIG. 4B
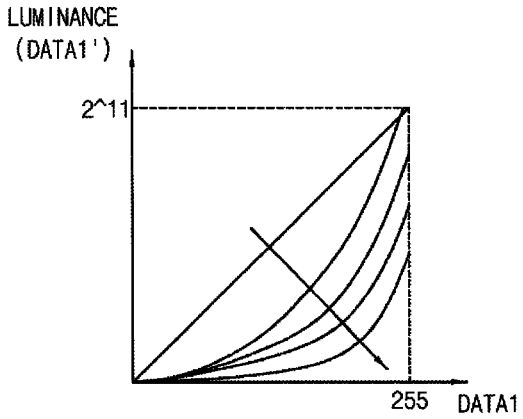

DISPLAY DEVICE AND METHOD FOR DRIVING THE SAME

CROSS REFERENCE TO RELATED APPLICATION

This application claims priority to and the benefit of Korean Patent Application No. 10-2015-0064351, filed on May 8, 2015, in the Korean Intellectual Property Office (KIPO), the disclosure of which is hereby incorporated by reference herein in its entirety.

BACKGROUND

1. Field

Aspects of example embodiments of the present invention relate to display devices.

2. Discussion of Related Art

The dimming technique used in a display device may include a register dimming technique (or, referred to as a data dimming technique), an impulse driving dimming technique, etc. In the resister dimming technique, a level of a data voltage that is applied to each pixel may be controlled to adjust a current flowing through a pixel. In the impulse driving dimming technique, an emission signal may be controlled to directly adjust a current flowing through the pixel. Namely, a luminance may be adjusted by periodically controlling the emission signal to have an 'on' level or an 'off' level.

Some register dimming technique may make a gamma voltage (or a grayscale voltage) reversal in certain luminance or grayscales.

When the register dimming technique is used in a low luminance, e.g., below about 10 cd/m$^2$, gray scale voltages for different grayscales may be overlapped. Further, when the impulse driving dimming technique is used in a low luminance, an on duty ratio may be too shortened, which may result in color shifting. Various dimming techniques (or luminance control techniques) may not perform an accurate dimming control (or an accurate luminance control).

The above information disclosed in this Background section is only for enhancement of understanding of the background of the described technology and therefore it may contain information that does not constitute prior art.

SUMMARY

Aspects of example embodiments of the present invention relate to display devices. For example, some example embodiments of the present invention relate to display devices and methods for driving the same to control luminance of an image using dimming techniques.

According to some example embodiments, a display device performs different dimming techniques based on luminance ranges (e.g., predetermined luminance ranges).

According to some example embodiments, a method for driving a display device includes performing different dimming techniques based on luminance ranges (e.g., predetermined luminance ranges).

According to some example embodiments, a display device includes: a display panel including a plurality of pixels configured to display an image; a gamma voltage generator configured to generate a plurality of gamma sets respectively corresponding to a plurality of luminance ranges, and configured to compare a target luminance level with the luminance ranges to select a target gamma set among the gamma sets, and to generate a plurality of gamma voltages using the target gamma set, the target luminance level being a luminance level of the image; a first dimming controller configured to scale input image data based on the target luminance level; a second dimming controller configured to determine an off duty ratio of an emission signal based on the target luminance level; and a display panel driver configured to drive the display panel based on the input image data and the gamma voltages.

The luminance ranges may be divided into a first luminance range and a second luminance range based on a first reference luminance level and may be divided into the second luminance range and a third luminance range based on a second reference luminance level that is higher than the first reference luminance level, and the third luminance range may be divided into a plurality of sub-ranges based on a plurality of sub-reference luminance levels that are higher than the second reference luminance level.

One of the gamma sets may be applied to the first and second luminance ranges in common.

The gamma sets, except the one of the gamma sets, may be respectively applied to the sub-ranges.

The first dimming controller may be configured to perform a data scaling to the input image data based on the target luminance level and a gamma curve to generate luminance correction image data, when the target luminance level is in the first luminance range or the third luminance range.

The gamma voltage generator may be configured to generate the gamma voltages based on the luminance correction image data using the target gamma set.

The first dimming controller may be configured to perform the data scaling to the input image data corresponding to a ratio of a selected one of the sub-reference luminance levels and the target luminance level such that the input image data are scaled linearly.

The second dimming controller may be configured to determine the off duty ratio based on a difference between the target luminance level and the second reference luminance level, and when the target luminance level is in the second luminance range, the off duty ratio may be changed linearly.

The second dimming controller may be configured to determine the off duty ratio to a predetermined value, when the target luminance level is in the first luminance range.

The second dimming controller may be configured to divide the second luminance range into a plurality of ranges, and adjust the off duty ratio of each of the ranges which has different change rate.

The first luminance range may range from a predetermined minimum luminance level to the first reference luminance level, the second luminance range may range from a level greater than the first reference luminance level to the second reference luminance level, and the third luminance range may range from a level greater than the second reference luminance level to a predetermined maximum luminance level.

The gamma voltage generator may further include: a gamma set controller configured to select a target range among the luminance ranges, and to activate the target gamma set corresponding to the target range that includes the target luminance level.

The display panel driver may include: a scan driver configured to provide a scan signal to the display panel; an emission driver configured to provide the emission signal to the display panel; a data driver configured to provide a data voltage that is generated based on the gamma voltage to the display panel; and a controller configured to control the scan driver, the emission driver, and the data driver.

According to some example embodiments of the present invention, in a method for driving a display device, the method includes: selecting a target gamma set among a plurality of gamma set included in a gamma voltage generator that generates gamma voltages respectively corresponding to a plurality of luminance ranges, the target gamma set including a target luminance level; generating luminance correction image data by a data scaling to input image data, that is provided to the gamma voltage generator, based on the target luminance level; generating target gamma voltages using the luminance correction image data and the target gamma set; adjusting an off duty ratio of an emission signal based on the target luminance level; and displaying an image having the target luminance level on a display panel based on the target gamma voltages and the off duty ratio.

The luminance ranges may be divided into a first luminance range and a second luminance range based on a first reference luminance level and may be divided into the second luminance range and a third luminance range based on a second reference luminance level that is higher than the first reference luminance level, and the third luminance range may be divided into a plurality of sub-ranges based on a plurality of sub-reference luminance levels that are higher than the second reference luminance level.

One of a plurality of gamma sets may be applied to the first and second luminance ranges in common.

The gamma sets, except the one of the gamma sets, may be respectively applied to the sub-ranges.

Generating the luminance correction image data may include: converting the input image data into converted image data proportional to a luminance change based on a gamma curve, when the target luminance level is in the first luminance range or the third luminance range; and generating luminance correction image data by a linear data scaling to the converted image data to corresponding to the target luminance level.

Adjusting the off duty ratio may include: setting the off duty ratio to 0%, when the target luminance level is in the third luminance range; linearly determining the off duty ratio based on a difference between the target luminance level and the second reference luminance level, when the target luminance level is in the second luminance range; and determining the off duty ratio to a predetermined value, when the target luminance level is in the first luminance range.

The first luminance range may range from a predetermined minimum luminance level to the first reference luminance level, the second luminance range may range from a level greater than the first reference luminance level to the second reference luminance level, and the third luminance range may range from a level greater than the second reference luminance level to a predetermined maximum luminance level.

Therefore, the display device and the method for driving the display device according to some example embodiments may simultaneously or concurrently perform the gamma voltage control based on the input image data scaling and the off duty ratio control (i.e., the impulse driving dimming) to control the luminance change. Thus, a color shift caused according to the impulse driving dimming and a grayscale distortion caused according to the register dimming may be eliminated or reduced in the low luminance (low grayscale) range. In addition, at least one of the gamma voltage control and the off duty ratio control may be performed according to the luminance ranges such that the gamma voltage reversal in certain grayscales by alternative register dimming techniques may be eliminated or reduced. Therefore, the display device may provide improved dimming operations and improve the luminance accuracy.

BRIEF DESCRIPTION OF THE DRAWINGS

Aspects of some example embodiments can be understood in more detail from the following description taken in conjunction with the accompanying drawings, in which:

FIG. 4A to 4C illustrates an example of which a first dimming controller converts an input gamma voltage;

DETAILED DESCRIPTION

Figure 1:
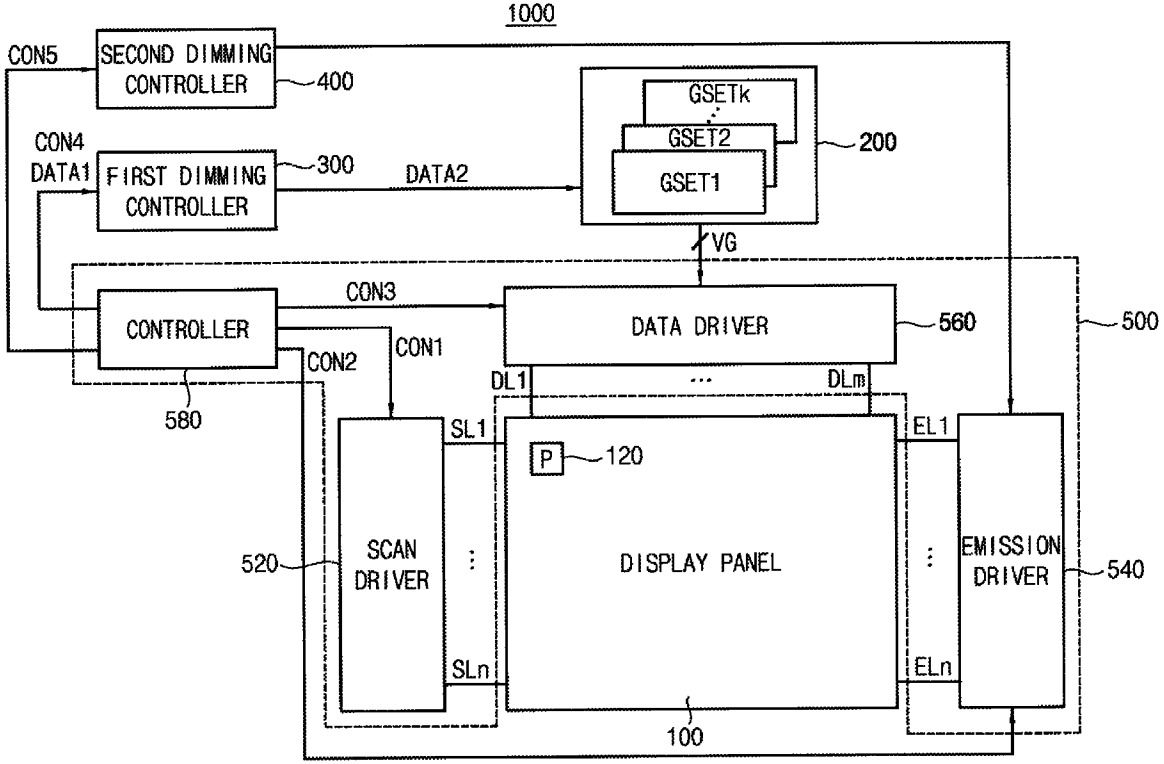
FIG. 1 is a block diagram of a display device according to example embodiments.

Aspects of example embodiments will be described more fully hereinafter with reference to the accompanying drawings, in which various embodiments are shown.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram of a display device according to example embodiments.

Referring to FIG. 1, the display device 1000 may include a display panel 100, a gamma voltage generator 200, a first dimming controller 300, a second dimming controller 400, and a display panel driver 500. In some embodiments, the display panel driver 500 may include a scan driver 520, an emission driver 540, a data driver 560, and a controller 580.

The display panel 100 may include a plurality of pixels 120. The display panel 100 may be connected to the scan driver 520 via a plurality of scan lines SL1 to SLn. The display panel 100 may be connected to the emission driver 540 via a plurality of emission lines EL1 to ELn. The display panel 100 may be connected to the data driver 560 via a plurality of data lines DL1 to DLm. The display panel 100 may include M (M is a positive integer) of pixel columns each connected to the respective data lines DL1 through DLm and N (N is a positive integer) of pixel rows each connected to the respective scan lines SL1 through SLn and the emission lines EL1 to ELn. Thus, the pixels 120 can be arranged in a matrix arrangement and the display panel 100 can include N*M pixels. In some embodiments, each of the pixels 120 may include an organic light emitting diode (OLED). Thus, the display device 1000 may be an organic light emitting display device. The pixels 120 may emit light having certain luminance level corresponding to a data voltage applied from the data driver 560 in response to the emission signal.

The gamma voltage generator 200 may set gamma voltage VG (or grayscale voltages) each corresponding to a plurality of grayscales. The gamma voltage generator 200 may receive input image data DATA1 from the controller 580 or receive corrected input image data DATA2 (e.g., luminance correction image data) from the first dimming controller 300. The gamma voltage generator 200 may generate a plurality of gamma corrected gamma voltages VG based on the input image data DATA1 or the corrected input image data DATA2, and output the gamma voltages VG to the data driver 560. The number of the gamma voltages VG may depend on the number of grayscales represented in the display device 1000. In some embodiments, the display device 1000 displays images in 256 grayscales and the number of the gamma voltages VG is 256.

The gamma voltage generator 200 may include a plurality of gamma sets GSET1 to GSETk corresponding to respective predetermined luminance ranges. The gamma voltage generator 200 may compare a target luminance level with the luminance ranges to select a target gamma set among the gamma sets, and to generate the gamma voltages VG using the target gamma set. The target luminance level may be a luminance level to be displayed in the image. In some embodiments, the gamma voltage generator 200 may select one among the gamma sets GSET1 to GSETk and adjust voltage levels of the gamma voltages VG based on the gamma sets GSET1 to GSETk to perform a luminance control and/or a dimming control. For example, the gamma voltage generator 200 may perform a dimming using a register dimming technique.

In some embodiments, the luminance ranges may be classified into a first luminance range, a second luminance range, and a third luminance range. The third luminance range may be classified into a plurality of sub-ranges. Here, selected one of the gamma sets GSET1 to GSETk (e.g., a first gamma set GSET1), may be applied to the first and second luminance ranges in common. The gamma sets GSET2 to GSETk except the first gamma set GSET1 may be respectively applied to the sub-ranges.

In some embodiments, the gamma voltage generator 200 may to determine a target range among the luminance ranges, and activate the target gamma set corresponding to the target range. The target luminance level may be included in the target range. Construction and operation of the gamma voltage generator 200 will be described in more detail with reference to FIG. 2.

The first dimming controller 300 may perform a data scaling to the input image data DATA1 based on the target luminance level. The first dimming controller 300 may receive the input image data DATA1 from the display panel driver 500. In some embodiments, the first dimming controller 300 may perform the data scaling to the input image data DATA1 based on the target luminance level and a gamma curve to generate luminance correction image data DATA2, when the target luminance level is in the first luminance range or the second luminance range. When the target luminance level is in the second luminance range, the first dimming controller 300 does not perform the data scaling to the input image data DATA1. The luminance correction image data DATA2 may be provided to an input terminal of the gamma voltage generator 200. In some embodiments, the gamma voltage generator 200 may generate gamma voltages (e.g., proper gamma voltages) VG for outputting the target luminance level based on the luminance correction image data DATA2. Accordingly, when the dimming or the luminance control is performed in the first luminance range or the third luminance range, the register dimming may be performed based on the data scaling of the first dimming controller 300 such that amplitudes of the gamma voltages VG may be changed according to the change of the luminance.

In some embodiments, the first luminance range may correspond to the lowest luminance range from about 0 to about 10 cd/m$^2$ and the third luminance range may correspond to middle luminance to high luminance ranges from about 100 to about 300 (or maximum luminance level) cd/m$^2$. Further, the second luminance range may correspond to low luminance to middle luminance ranges between the first luminance range and the third luminance range.

The second dimming controller 400 may determine the off duty ratio of the emission signal based on the target luminance level. The off duty ratio may indicate a ratio of an 'off' period of the emission signal to a period corresponding to one frame. The second dimming controller 400 may perform an impulse driving dimming by adjusting the off duty ratio such that luminance may be controlled. In some embodiments, when the target luminance level is in the second luminance range, the second dimming controller 400 may linearly determine the off duty ratio based on a difference between the target luminance level.

For example, as the target luminance level decreases, the off duty ratio may be linearly increase. In some embodiments, when the target luminance level is in the first luminance range, the second dimming controller 400 may determine the off duty ratio to a value (e.g., a predetermined value). In the first luminance range, the off duty ratio of the emission signal may be maintained to have a specific value. The second dimming controller 400 may control the off duty ratio in the first and second luminance to change driving currents flowing into the pixels 120, such that the luminance control and the dimming is performed. For example, in the first luminance range (e.g., in the lowest luminance range), the display device 1000 may simultaneously (e.g., concurrently) perform controlling the amplitudes of the gamma voltages VG and controlling the off duty ratio to control the luminance or perform the dimming operation.

The display panel driver 500 may drive the display panel 100 based on the input image data DATA1 (or, the luminance correction image data DATA2) and the gamma voltages VG. In some embodiments, the display panel driver 500 may include the scan driver 520, the emission driver 540, the data driver 560, and the controller 580.

The scan driver 520 may provide a scan signal to the display panel 100 via the plurality of scan lines SL1 to SLn. In some embodiments, each of the scan lines SL1 to SLn may be connected to pixel 120 arranged in one of the pixel rows.

The emission driver 540 may provide the emission signal to the display panel 100 via the plurality of emission lines EL1 to ELn. In some embodiments, each of the emission lines EL1 to ELn may be connected to pixel 120 arranged in one of the pixel rows.

The data driver 560 may provide the data voltage which is generated based on selected gamma voltages VG to the display panel 100 via the plurality of data lines DL1 to DLm. The data driver 560 may generate analog data voltage using control signal CON3 receiving from the controller 580 and the gamma voltages VG receiving from the gamma voltage generator 200.

The controller 580 may control the scan driver 520, the emission driver 540, and the data driver 560 based on first to third control signals CON1, CON2, and CON3. In some embodiments, the controller 580 may receive an input control signal and image data from an image source, e.g., an external graphic apparatus. The input control signal may include a main clock signal, a vertical synchronizing signal, a horizontal synchronizing signal, and a data enable signal. The controller 580 may generate input image data DATA1 corresponding to operating conditions of the display panel 100 based on the image data and provide the input image data DATA1 to the data driver 560 or the first dimming controller 300. In some embodiments, the controller 580 may select the target range among the luminance ranges. The target range may include the target luminance level. The controller 580 may generate fourth and fifth control signals CON4 and CON5 based on the selected target range. The controller 580 may provide the fourth and fifth control signals CON4 and CON5 to the first and second dimming controllers 300 and 400 and control the first and second dimming controllers 300 and 400 based on the fourth and fifth control signals CON4 and CON5, respectively.

In some embodiments, when the target luminance level is in the first luminance range, the first and second dimming controllers 300 and 400 may perform the dimming operation. When the target luminance level is in the second luminance range, only the second dimming controller 400 may perform the dimming operation. When the target luminance level is in the third luminance range, only the first dimming controller 300 may perform the dimming operation.

As described above, the display device 1000 may perform different dimming operations (or luminance control operations) according to the luminance ranges, so that more natural dimming may be provided and luminance accuracy may be improved.

Figure 2:
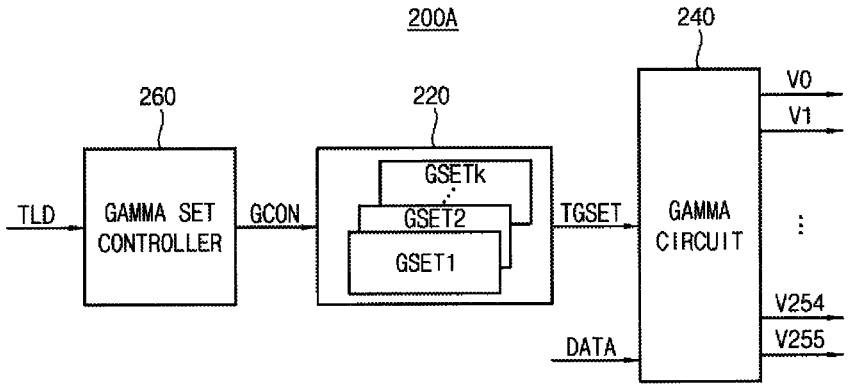
FIG. 2 illustrates an example of a gamma voltage generator included in the display device of FIG. 1.

FIG. 2 illustrates an example of a gamma voltage generator included in the display device of FIG. 1.

Referring to FIGS. 1 and 2, the gamma voltage generator 200A may include a plurality of gamma sets 220 and a gamma circuit 240 for outputting a plurality of gamma voltages V0 to V255. The gamma voltage generator 200A may further include a gamma set controller 260 to activate selected one of the gamma sets 220.

The gamma sets 220 may be selectively activated corresponding to a plurality of luminance ranges, respectively. Each of the gamma sets 220 may define reference gamma voltages representing certain luminance levels or ranges. For example, the gamma voltage generator 200A may include 7 gamma sets 220 respectively corresponding to 7 luminance levels. A first gamma set GSET1, for example, may define the gamma voltages corresponding to a first reference luminance level about 100 cd/m$^2$. The gamma sets 220 may operate in corresponding luminance ranges each including a corresponding reference luminance level, respectively. In this, an interpolation between the reference luminance levels for indicating luminance levels between the reference luminance levels is not used. Thus, a gamma voltage reversal in certain grayscales may not happen.

In some embodiments, the luminance range indicated by the display device may be classified into first to third luminance ranges. The first luminance ranges may have the lowest luminance level and the third luminance ranges may have the highest luminance level. The third luminance range may be classified into a plurality of sub-ranges. Here, the first gamma set GSET1 may be applied to the first and second luminance ranges. The gamma sets GSET2 to GSETk except the first gamma set GSET1 may be applied to the sub-ranges, respectively.

In some embodiments, the gamma set controller 260 may select a target gamma set TGSET such that the gamma voltages V0 to V255 may be generated based on the target gamma set TGSET.

The gamma circuit 240 output the gamma voltages V0 to V255 based on the image data DATA (e.g., input image data DATA1 or luminance correction image data DATA2) and the target gamma set TGSET. The gamma circuit 240 may include a plurality of selectors (or multiplexers) and a plurality of resistor strings to output the gamma voltages V0 to V255.

In some embodiments, the image data may be the input image data DATA1 applied from the controller 580 or the luminance correction image data DATA2 applied from the first dimming controller 300. For example, when the target luminance level is in the second luminance range in which the first dimming controller does not operate, the gamma set controller 260 may receive the input image data DATA1 from the controller 580. In contrast, when the target luminance level is in the first or third luminance range, the gamma set controller 260 may receive the luminance correction image data DATA2 from the first dimming controller 300.

The gamma set controller 260 may select a target range among the luminance ranges, and activate the target gamma set TGSET corresponding to the target range. The target range may include the target luminance level. In some embodiments, the gamma set controller 260 may receive target luminance level data TLD from the first dimming controller 300 or the controller 580. The target luminance data may include the target luminance level that is determined by a user's input, a luminance control according to external light, a luminance control according to a battery voltage, etc.

The gamma set controller 260 may generate a gamma control signal GOON to select and activate the target gamma set TGSET. The target gamma set GSET selected by the gamma control signal GOON may be used for gamma voltage generating operation of the gamma circuit 240.

Figure 3:
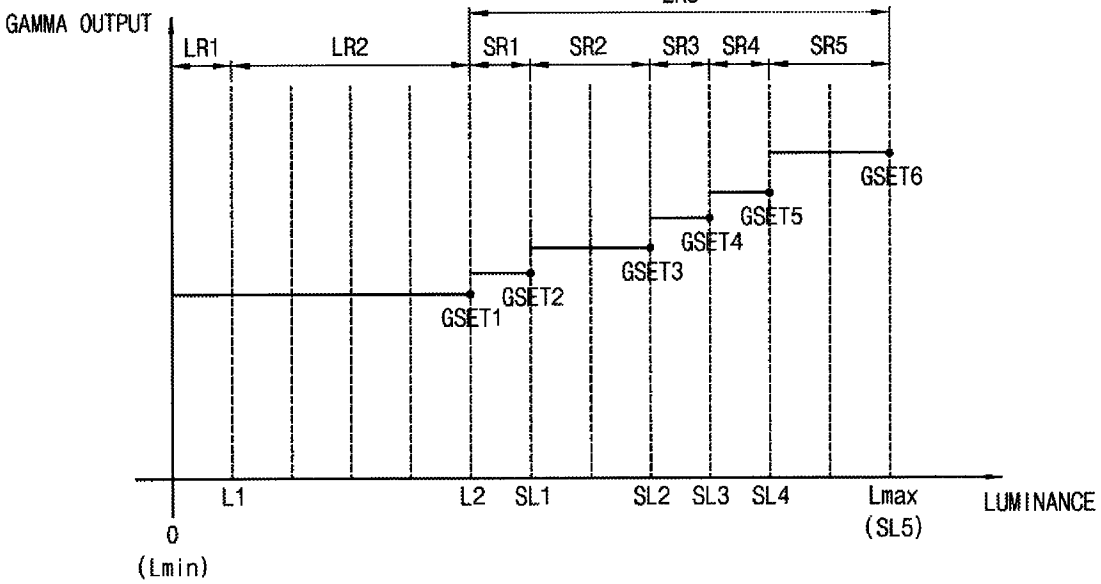
FIG. 3 illustrates an example of which a gamma voltage generator in the display device of FIG. 1 selects a gamma set according to luminance level.

FIG. 3 illustrates an example of which a gamma voltage generator in the display device of FIG. 1 selects a gamma set according to luminance level.

Referring to FIGS. 1 and 3, the display device 1000 may set a plurality of gamma sets to corresponding to a plurality of luminance ranges, respectively.

Although FIG. 3 illustrates an example that reference luminance levels are indicated by 6 gamma sets, the number of gamma sets is not limited thereto.

In some embodiments, the luminance ranges may be divided into a first luminance range LR1 and a second luminance range LR2 based on a first reference luminance level L1 and divided into the second luminance range LR2 and a third luminance range LR3 based on a second reference luminance level L2 that is higher than the first reference luminance level L1. Here, the third luminance range LR3 may be divided into a plurality of sub-ranges SR1 to SR5 based on a plurality of sub-reference luminance levels SL1 to SL4 that are higher than the second reference luminance level L2. Here, the first luminance range LR1 may correspond to from a predetermined minimum luminance level Lmin to the first reference luminance level L1. The second luminance range LR2 may correspond to from a level greater than the first reference luminance level L1 to the second reference luminance level L2. The third luminance range LR3 may correspond to from a level greater than the second reference luminance level L2 to a predetermined maximum luminance level Lmax.

In some embodiments, the first luminance range LR1 may correspond to the lowest luminance range from about 0 cd/m$^2$ to about 10 cd/m$^2$ and the third luminance range LR3 may correspond to middle luminance to high luminance ranges from about 100 cd/m$^2$ to about 300 (or maximum luminance level) cd/m$^2$. Further, the second luminance range LR2 may correspond to low luminance to middle luminance ranges between the first luminance range LR1 and the third luminance range LR3.

As illustrated in FIG. 3, a first gamma set GSET1 may correspond to the second reference luminance level L2, second to sixth gamma sets GSET2 to GSET6 may correspond to first to fifth sub-reference luminance levels SL1 to SL5, respectively. The first gamma set GSET1 may be applied to luminance levels that are included in the first and second luminance ranges LR1 and LR2. The second gamma set GSET2 may be applied to luminance levels that are included in the first sub-range SR1. Similarly, the third to sixth gamma sets GSET3 to GSET6 may be applied to second to fifth sub-ranges SR2 to SR5. In this, an interpolation between the reference luminance levels (e.g., between L1 and L2) for indicating luminance levels between the reference luminance levels (e.g., between L1 and L2) is not used.

Accordingly, a gamma voltage control for dimming (i.e., the register dimming technique) may be performed in the third luminance range LR3, such as above about 100 cd/m$^2$.

Figure 4C:
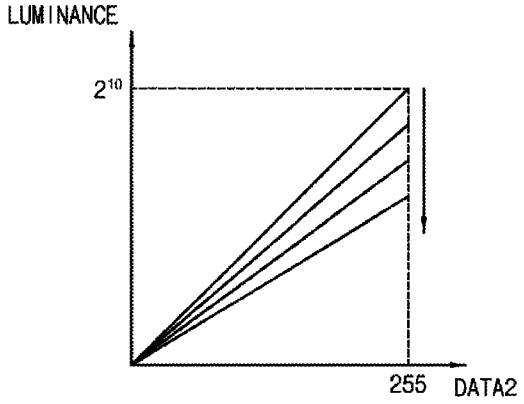
Figure 5:
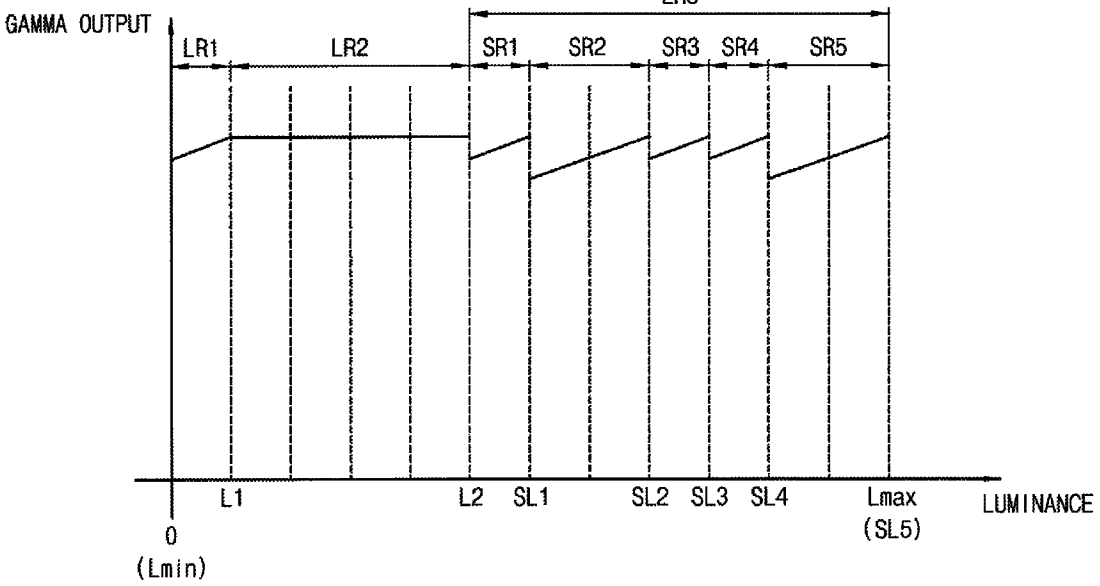
FIG. 5 illustrates an example of an operation of a first dimming controller included in the display device of FIG. 1.

FIG. 4A to 4C illustrates an example of which a first dimming controller converts an input gamma voltage. FIG. 5 illustrates an example of an operation of a first dimming controller included in the display device of FIG. 1.

Referring to FIGS. 1, 3, 4A to 4C, and 5, the first dimming controller 300 may scales linearly the input image data DATA1 based on the target luminance level. In this case, the target luminance level may be included in the first luminance range LR1 or the third luminance range LR3.

In some embodiments, the first dimming controller 300 may perform a data scaling to the input image data DATA1 based on the target luminance level and a gamma curve to generate luminance correction image data DATA2, when the target luminance level is in the first luminance range LR1 or the second luminance range.

In some embodiments, as illustrated in FIG. 4A, the 8 bit input image data DATA1 may represent luminance of 256 levels. The input image data DATA1 is not linearly proportional to the luminance. Thus, the first dimming controller 300 my convert the input image data DATA1 into converted image data DATA1' based on the gamma curve. For example, as illustrated in FIG. 4B, the first dimming controller 300 may convert the input image data DATA1 into a gamma 2.2 curve. Thus, the converted image data DATA1' may be substantially proportional to actual luminance. The 8 bit input image data DATA1 may be mapped into 11 bit converted image data DATA1' to implement smooth gamma curve. When the target luminance level decreases, a relation between the converted image data DATA1' and the luminance may change in the direction of an arrow of FIG. 4B.

As illustrated in FIG. 4C, the first dimming controller 300 may scale linearly the converted image data DATA1' according to the target luminance level. The converted image data DATA1' is substantially proportional to the luminance change, so that the converted image data DATA1' may be scaled linearly into the luminance correction image data DATA2. The luminance correction image data DATA2 may be applied to the gamma voltage generator 200. When the target luminance level decreases, the relation between the luminance correction image data DATA2 and the luminance may change in the direction of an arrow of FIG. 4C.

As illustrated in FIG. 5, the first dimming controller 300 may perform the linear data scaling according to each luminance range. In some embodiments, when the target luminance level is in the first luminance range LR1, the first dimming controller 300 may perform the data scaling to the input image data DATA1 corresponding to a ratio of the first reference luminance level L1 and the target luminance level such that the input image data DATA1 are scaled linearly. Because the first luminance range LR1 is the lowest luminance range from about 0 to about 10 cd/m$^2$, very low gamma voltage may be required to perform a dimming operation in the typical register dimming technique that adjusts amplitudes of the gamma voltages. Thus, it may be difficult to distinguish the low luminance levels in the typical register dimming. In addition, when the impulse driving dimming technique is used in the lowest luminance range, an on duty ratio may be too shortened such that color shift may be caused. Thus, example embodiments of the display device 1000 may perform the dimming operation based on the controlling (data scaling) the input image data DATA1 in the first luminance range LR1 to overcome the color distortion and the color shift problems.

In some embodiments, when the target luminance level is in the third luminance range LR3, as illustrated in FIG. 5, the first dimming controller 300 may perform the data scaling to the input image data DATA1 corresponding to a ratio of selected one of the sub-reference luminance levels SL1 to SL5 and the target luminance level such that the input image data DATA1 may be scaled linearly. The luminance correction image data DATA2 generated by the data scaling may be provided to the gamma voltage generator 200.

Figure 6:
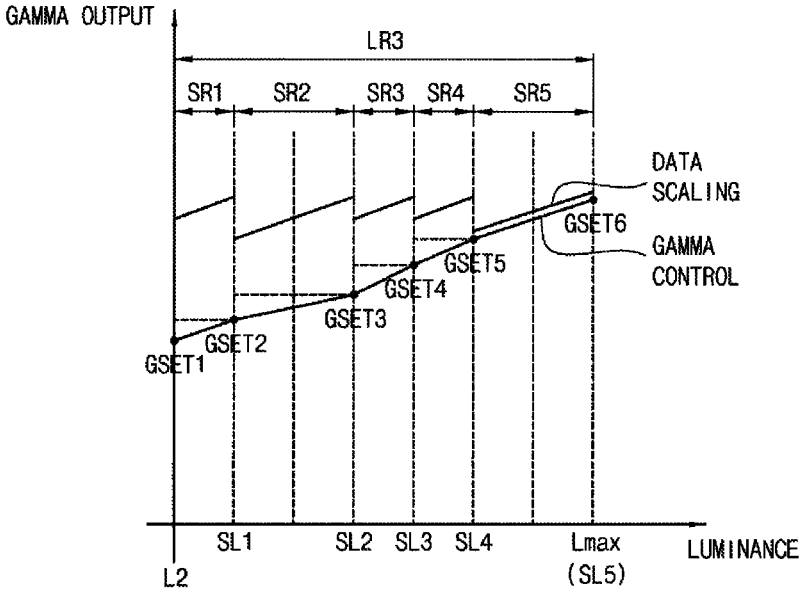
FIG. 6 illustrates an example of which a gamma voltage generator outputs a gamma voltage based on an operation of the first dimming controller of FIG. 5.

FIG. 6 illustrates an example of which a gamma voltage generator outputs a gamma voltage based on an operation of the first dimming controller of FIG. 5.

Referring to FIGS. 5 and 6, the gamma voltage generator 200 may generate gamma voltages using a target gamma set based on the luminance correction image data DATA2.

FIG. 6 shows an example of a method for controlling the luminance in the third luminance range LR3.

The first dimming controller 300 may output the luminance correction image data DATA2 by the data scaling. The gamma voltage generator 200 may select a target gamma set corresponding to a luminance range which includes the target luminance level. The gamma voltage generator 200 may adjust the gamma voltages with respect to the luminance change based on the luminance correction image data DATA2. In other words, the luminance control or the dimming operation in the third luminance range LR3 may be performed by combination of the input image data DATA1 scale and the gamma voltage control. In this case, the second dimming controller 400 for adjusting the off duty ratio does not operate. Accordingly, the off duty ratio may be substantially 0%.

Although it is not illustrated in FIG. 6, the display device 1000 may further perform the combination of the input image data DATA1 scale and the gamma voltage control in the first luminance range LR1.

Figure 7:
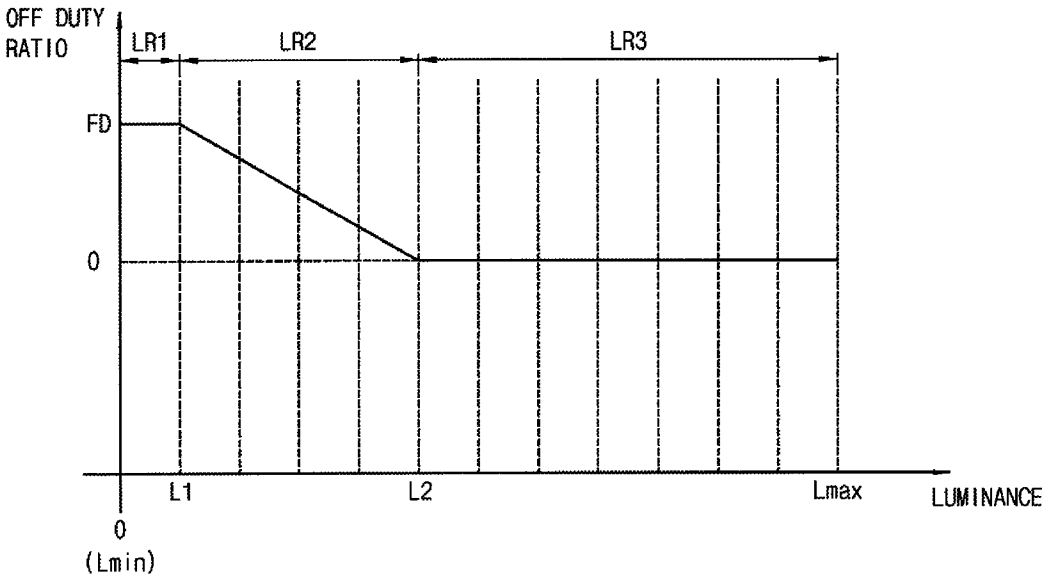
FIG. 7 illustrates an example of an operation of a second dimming controller included in the display device of FIG. 1.

FIG. 7 illustrates an example of an operation of a second dimming controller included in the display device of FIG. 1.

Referring to FIGS. 1, 3, and 7, the second dimming controller 400 may determine the off duty ratio of the emission signal based on the target luminance level.

In some embodiments, when the target luminance level is in the second luminance range LR2, the second dimming controller 400 may linearly determine the off duty ratio based on a difference between the target luminance level and the second reference luminance level L2. The second LR2 may correspond to low luminance to middle luminance ranges from about 10 cd/m$^2$ to about 100 cd/m$^2$. The second dimming controller 400 may control the off duty ratio in proportional to the luminance such that driving currents of pixels may be changed. Accordingly, the impulse dimming operation may be performed in the second luminance range LR2.

If the dimming for controlling the off duty ratio is applied in the third luminance range LR3, power consumption may increase. Thus, the second dimming controller 400 does not operate in the third luminance range LR3. Therefore, the off duty ratio may be 0% in the third luminance range LR3.

In some embodiments, when the target luminance level is in the first luminance range LR1, the second dimming controller 400 may determine off duty ratio to a predetermined value. As described above, if the off duty ratio increases in the lowest luminance range, the on duty ratio may be too shortened such that color shift may be caused. Thus, the second dimming controller 400 may control the off duty level to maintain the predetermined value FD in the first luminance range LR1. For example, the predetermined off duty ratio FD may be set to about 80%.

As described above, both the first and second dimming controllers 300 and 400 may be used for controlling the luminance when the target luminance level is in the first luminance range LR1. When the target luminance level is in the second luminance range LR2, only the second dimming controller 400 may be used for controlling the luminance (i.e., the impulse driving dimming). When the target luminance level is in the third luminance range LR3, only the first dimming controller 300 may be used for controlling the luminance (i.e., gamma voltage control using linear data scaling to the input image data DATA1). Thus, the color shift and the color distortion in the low luminance and/or low grayscale range by the typical impulse driving dimming technique may be eliminated. Further, the gamma voltage reversal in certain grayscales by the typical register dimming technique may be eliminated. Therefore, the display device 1000 may provide improved dimming operations and improve the luminance accuracy.

Figure 8:
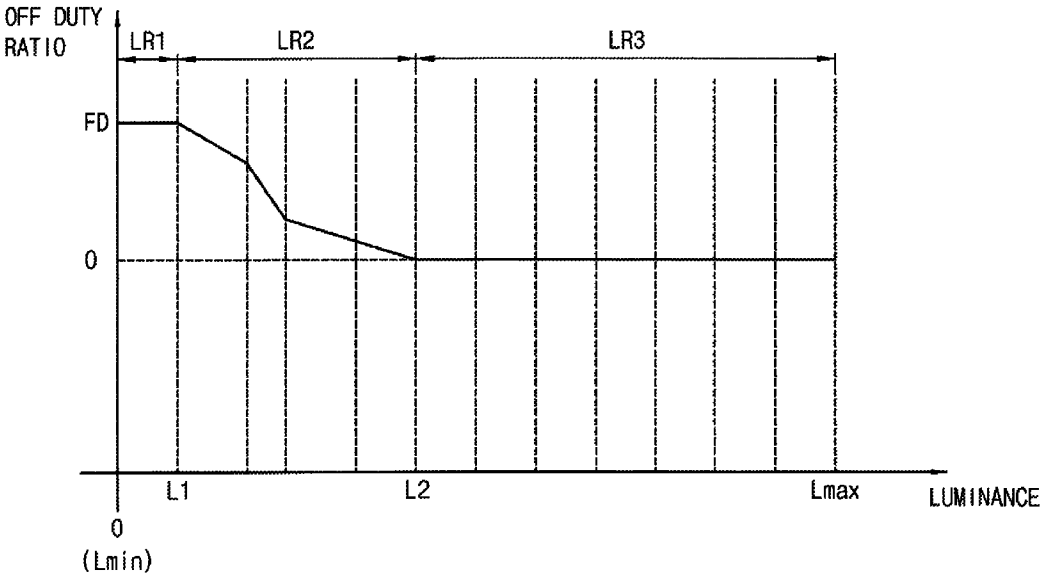
FIG. 8 illustrates another example of an operation of a second dimming controller included in the display device of FIG. 1.

FIG. 8 illustrates another example of an operation of a second dimming controller included in the display device of FIG. 1.

Referring to FIG. 8, the second dimming controller 400 may determine an off duty ratio of an emission signal based on a target luminance level.

In example embodiments, as illustrated in FIG. 8, the second dimming controller 400 may divide the second luminance range LR2 into a plurality of ranges, and adjust the off duty ratio of each of the ranges which has different change rate. The rate of change of each off duty ratio in the ranges may be different. Thus, the more accurate luminance control may be possible.

Figure 9:
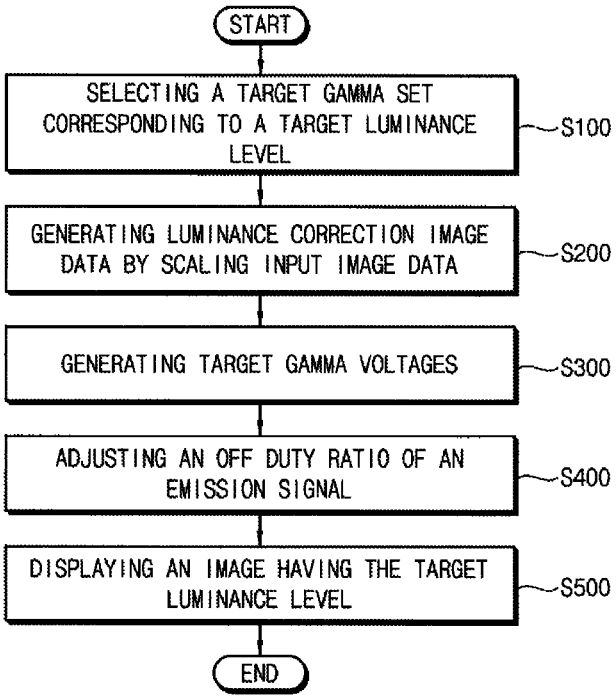
FIG. 9 is a flow chart of a method for driving a display device according to example embodiments.
Figure 10:
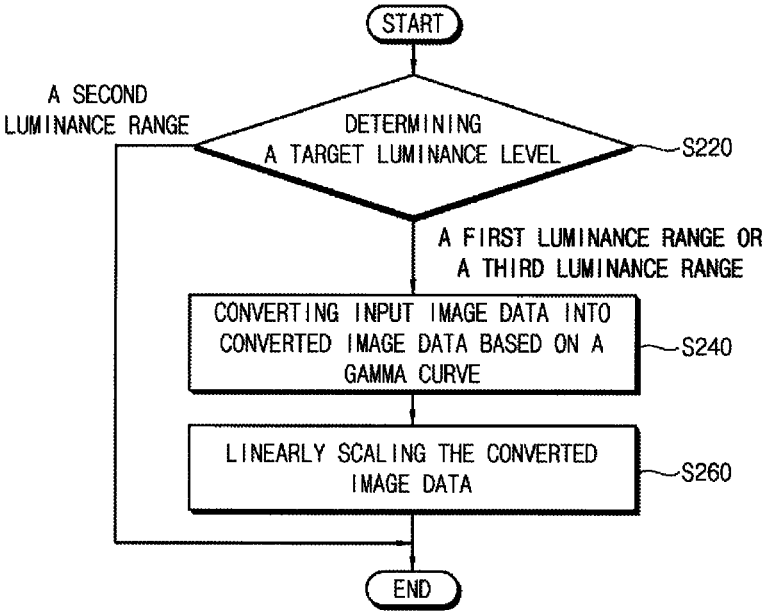
FIG. 10 is a flow chart illustrating an example of scaling input image data in the method of FIG. 9.
Figure 11:
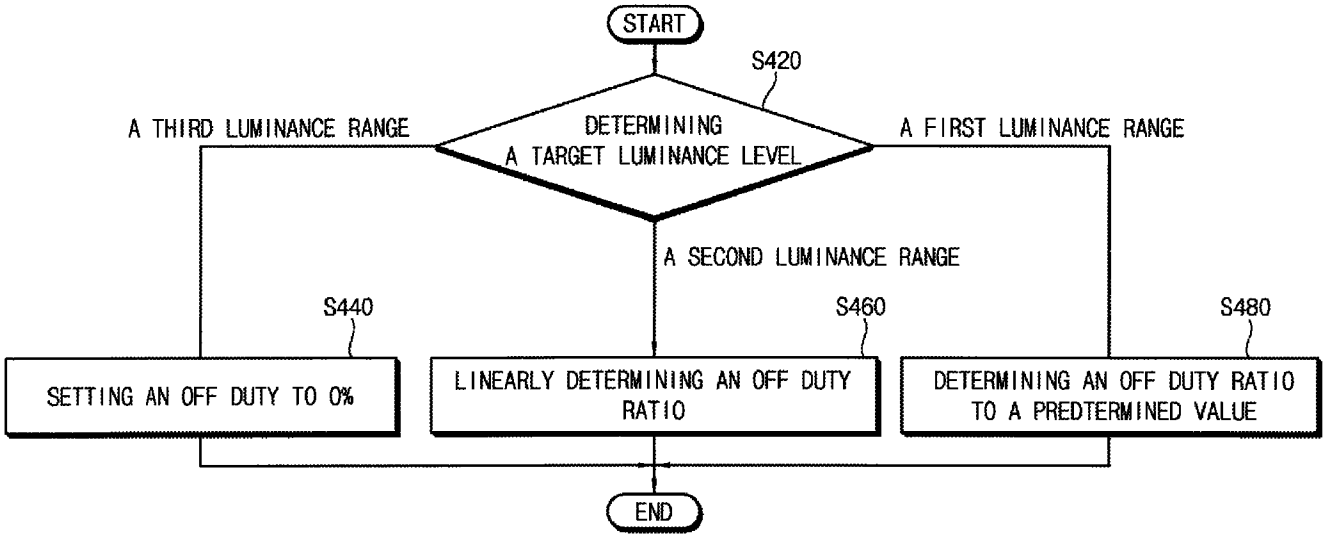
FIG. 11 is a flow chart illustrating an example of adjusting an off duty ratio of an emission signal in the method of FIG. 9.

FIG. 9 is a flow chart of a method for driving a display device according to example embodiments. FIG. 10 is a flow chart illustrating an example of scaling input image data in the method of FIG. 9. FIG. 11 is a flow chart illustrating an example of adjusting an off duty ratio of an emission signal in the method of FIG. 9.

Referring to FIGS. 9 to 11, the method for driving the display device may include selecting a target gamma set corresponding to a target luminance level S100, generating a luminance correction image data by a data scaling to input image data S200, and generating target gamma voltages using the target gamma set and the luminance correction image data S300. Further, the method for driving the display device may include adjusting an off duty ratio of an emission signal based on the target luminance level S400 and displaying an image having the target luminance level on a display panel based on the target gamma voltages and the off duty ratio S500.

First, a luminance range for performing the dimming operation or the luminance control operation. In some embodiments, the luminance range may be divided into a first luminance range and a second luminance range based on a first reference luminance level and divided into the second luminance range and a third luminance range based on a second reference luminance level that is higher than the first reference luminance level.

The third luminance range may be divided into a plurality of sub-ranges based on a plurality of sub-reference luminance levels that are higher than the second reference luminance level. In some embodiments, the first luminance range may correspond to from a predetermined minimum luminance level to the first reference luminance level, the second luminance range may correspond to from a level greater than the first reference luminance level to the second reference luminance level, and the third luminance range may correspond to from a level greater than the second reference luminance level to a predetermined maximum luminance level.

For example, the first luminance range may correspond to the lowest luminance range from about 0 to about 10 cd/m$^2$ and the third luminance range may correspond to middle luminance to high luminance ranges from about 100 to about 300 (or maximum luminance level) cd/m$^2$. Further, the second luminance range may correspond to low luminance to middle luminance ranges between the first luminance range and the third luminance range.

In some embodiments, the target gamma set corresponding to the target luminance level may be set S100. The target gamma set may be one of a plurality of gamma sets each corresponding to respective predetermined luminance ranges. The target gamma set may correspond to the target luminance level. In some embodiments, one of the gamma sets may be applied to the first and second luminance ranges in common. The gamma sets and the operations for selecting the target gamma set are described above referred to FIGS. 2 and 3, duplicate descriptions will not be repeated.

The luminance correction image data may be generated S200. Input image data applied to the gamma voltage generator may be scaled into the luminance correction image data based on the target luminance level. First of all, as illustrated in FIG. 10, the data scaling process of the input image data may determine (or selecting) the target luminance range including the target luminance level S220.

When the target luminance level is in the first luminance range and the third luminance range, the input image data may be converted into converted image data proportional to a luminance change based on a gamma curve S240. For example, the input image data the input image data may be converted into a gamma 2.2 curve such that the converted image data may be substantially proportional to the luminance change.

The luminance correction image data may be generated by a linear data scaling to the converted image data to corresponding to the target luminance level S260. The converted image data are substantially proportional to the luminance change such that the luminance correction image data may be substantially proportional to the luminance change.

When the target luminance level is in the second luminance range, the gamma voltage control dimming by the data scaling of the input image data does not performed.

The garget gamma voltages may be generated by using the luminance correction image data and the target gamma set S300. The target gamma voltages may be adjusted by the target gamma set that is selected according to the target luminance level such that dimming operation may be controlled. Accordingly, the gamma voltage control dimming operation based on the input image data scaling may be performed in the first and third luminance ranges.

The off duty ratio of the emission signal may be adjusted based on the target luminance level S400. The display device may perform the impulse driving dimming operation. In some embodiments, the off duty ratio may have different rate of change in each luminance range.

As illustrated in FIG. 11, the adjusting the off duty ratio process may determine (or selecting) the target luminance range including the target luminance level S420. For example, the target luminance level may be included in the first luminance range or the third luminance range. When the target luminance level is in the third luminance range, the off duty ratio maybe set to 0% S440. In the third luminance range, the impulse driving dimming does not operate. Only the gamma voltage control dimming by the input image data scaling may be performed in the third luminance range.

When the target luminance level is in the second luminance range, the off duty ratio may be determined linearly based on a difference between the target luminance level and the second reference luminance level S460. Accordingly, only the impulse driving dimming may be performed in the second luminance range.

When the target luminance level is in the first luminance range, the off duty ratio may be determined to have a predetermined value S480. Thus, in the first luminance range, the impulse driving dimming and the gamma voltage control dimming by the input image data scaling may be simultaneously performed.

The dimming operations according to the luminance ranges are described above referred to FIGS. 2 to 8, duplicate descriptions will not be repeated.

As described above, the method for driving the display device may perform at least one of the dimming operations, which are the impulse driving dimming and the gamma voltage control dimming by the input image data scaling, according to the luminance ranges, such that the luminance may be changed naturally.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and aspects of example embodiments. Accordingly, all such modifications are intended to be included within the scope of example embodiments as defined in the claims, and their equivalents. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device comprising:

a display panel comprising a plurality of pixels configured to display an image;

a gamma voltage generator configured to generate a plurality of gamma sets respectively corresponding to a plurality of luminance ranges, and configured to compare a target luminance level with the luminance ranges to select a target gamma set among the gamma sets, and to generate a plurality of gamma voltages using the target gamma set, the target luminance level being a luminance level of the image;

a first dimming controller configured to scale input image data based on the target luminance level;

a second dimming controller configured to determine an off duty ratio of an emission signal based on the target luminance level, the off duty ratio of the emission signal indicating a ratio of an off period of the emission signal to a period corresponding to one frame; and a display panel driver configured to drive the display panel based on the input image data and the gamma voltages, wherein the luminance ranges are divided into a first luminance range and a second luminance range based on a first reference luminance level and divided into the second luminance range and a third luminance range based on a second reference luminance level that is higher than the first reference luminance level, wherein the first dimming controller is configured to perform a data scaling to the input image data, when the target luminance level is in the first luminance range or the third luminance range, and wherein the second dimming controller is configured to adjust the off duty ratio, when the target luminance level is in the second luminance range.

2. The display device of claim 1, wherein the third luminance range is divided into a plurality of sub-ranges based on a plurality of sub-reference luminance levels that are higher than the second reference luminance level.

3. The display device of claim 2, wherein one of the gamma sets is applied to the first and second luminance ranges in common.

4. The display device of claim 3, wherein the gamma sets, except the one of the gamma sets, are respectively applied to the sub-ranges.

5. The display device of claim 2, wherein the first dimming controller is configured to perform a data scaling to the input image data based on the target luminance level and a gamma curve to generate luminance correction image data, when the target luminance level is in the first luminance range or the third luminance range.

6. The display device of claim 5, wherein the gamma voltage generator is configured to generate the gamma voltages based on the luminance correction image data using the target gamma set.

7. The display device of claim 5, wherein the first dimming controller is configured to perform the data scaling to the input image data corresponding to a ratio of a selected one of the sub-reference luminance levels and the target luminance level such that the input image data are scaled linearly.

8. The display device of claim 5, wherein the second dimming controller is configured to determine the off duty ratio based on a difference between the target luminance level and the second reference luminance level, and when the target luminance level is in the second luminance range, the off duty ratio is changed linearly.

9. The display device of claim 5, wherein the second dimming controller is configured to determine the off duty ratio to a predetermined value, when the target luminance level is in the first luminance range.

10. The display device of claim 5, wherein the second dimming controller is configured to divide the second luminance range into a plurality of ranges, and adjust the off duty ratio of each of the ranges which has different change rate.

11. The display device of claim 2, wherein the first luminance range ranges from a predetermined minimum luminance level to the first reference luminance level, the second luminance range ranges from a level greater than the first reference luminance level to the second reference luminance level, and the third luminance range ranges from a level greater than the second reference luminance level to a predetermined maximum luminance level.

12. The display device of claim 1, wherein the gamma voltage generator further comprises:

a gamma set controller configured to select a target range among the luminance ranges, and to activate the target gamma set corresponding to the target range that comprises the target luminance level.

13. The display device of claim 1, wherein the display panel driver comprises:

a scan driver configured to provide a scan signal to the display panel;

an emission driver configured to provide the emission signal to the display panel;

a data driver configured to provide a data voltage that is generated based on the gamma voltage to the display panel; and a controller configured to control the scan driver, the emission driver, and the data driver.

14. A method for driving a display device, the method comprising:

selecting a target gamma set among a plurality of gamma set included in a gamma voltage generator that generates gamma voltages respectively corresponding to a plurality of luminance ranges, the target gamma set comprising a target luminance level, wherein the luminance ranges are divided into a first luminance range and a second luminance range based on a first reference luminance level and divided into the second luminance range and a third luminance range based on a second reference luminance level that is higher than the first reference luminance level;

generating luminance correction image data by a data scaling to input image data, that is provided to the gamma voltage generator, based on the target luminance level, when the target luminance level is in the first luminance range or the third luminance range;

generating target gamma voltages using the luminance correction image data and the target gamma set, when the target luminance level is in the third luminance range;

adjusting an off duty ratio of an emission signal based on the target luminance level, the off duty ratio of the emission signal indicating a ratio of an off period of the emission signal to a period corresponding to one frame; and displaying an image having the target luminance level on a display panel based on the target gamma voltages and the off duty ratio.

15. The method of claim 14, wherein the third luminance range is divided into a plurality of sub-ranges based on a plurality of sub-reference luminance levels that are higher than the second reference luminance level.

16. The method of claim 15, wherein one of a plurality of gamma sets is applied to the first and second luminance ranges in common.

17. The method of claim 16, wherein the gamma sets, except the one of the gamma sets, are respectively applied to the sub-ranges.

18. The method of claim 15, wherein generating the luminance correction image data comprises:

converting the input image data into converted image data proportional to a luminance change based on a gamma curve, when the target luminance level is in the first luminance range or the third luminance range; and generating luminance correction image data by a linear data scaling to the converted image data to corresponding to the target luminance level.

19. The method of claim 18, wherein adjusting the off duty ratio comprises:

setting the off duty ratio to 0%, when the target luminance level is in the third luminance range;

linearly determining the off duty ratio based on a difference between the target luminance level and the second reference luminance level, when the target luminance level is in the second luminance range; and determining the off duty ratio to a predetermined value, when the target luminance level is in the first luminance range.

20. The method of claim 15, wherein the first luminance range ranges from a predetermined minimum luminance level to the first reference luminance level, the second luminance range ranges from a level greater than the first reference luminance level to the second reference luminance level, and the third luminance range ranges from a level greater than the second reference luminance level to a predetermined maximum luminance level.

* * * * *